US011692411B2

(12) United States Patent
Vasques

(10) Patent No.: US 11,692,411 B2
(45) Date of Patent: Jul. 4, 2023

(54) ANNULAR BARRIER AND DOWNHOLE SYSTEM

(71) Applicant: Welltec Oilfield Solutions AG, Zug (CH)

(72) Inventor: Ricardo Reves Vasques, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 0 days.

(21) Appl. No.: 17/719,813

(22) Filed: Apr. 13, 2022

(65) Prior Publication Data

US 2022/0333456 A1 Oct. 20, 2022

(30) Foreign Application Priority Data

Apr. 16, 2021 (EP) ..... 21168969
Nov. 3, 2021 (EP) ..... 21206317

(51) Int. Cl.
*E21B 33/124* (2006.01)
*E21B 33/127* (2006.01)

(52) U.S. Cl.
CPC ..... *E21B 33/1243* (2013.01); *E21B 33/127* (2013.01); *E21B 33/1272* (2013.01); *E21B 33/1277* (2013.01)

(58) Field of Classification Search
CPC ..... E21B 33/1243; E21B 33/1272; E21B 33/1277; E21B 33/127
See application file for complete search history.

(56) References Cited

U.S. PATENT DOCUMENTS 5,101,908 A 4/1992 Mody
10,731,442 B2 * 8/2020 Kumar ..... E21B 43/08
(Continued)

FOREIGN PATENT DOCUMENTS

EP 2 876 252 5/2015
EP 3 327 246 5/2018

OTHER PUBLICATIONS

Extended European Search Report for EP 21168969.0, dated Oct. 12, 2021 (5 pages).

*Primary Examiner* — Yong-Suk (Philip) Ro
(74) *Attorney, Agent, or Firm* — Nixon & Vanderhye P.C.

(57) ABSTRACT

The present invention relates to an annular barrier for providing isolation of a zone in a well having an isolation layer of less than 5 metres, comprising a tubular metal part configured to be mounted as part of a well tubular metal structure, the tubular metal part having an outer face, an opening and an axial extension along the well tubular metal structure, a first expandable metal sleeve surrounding the tubular metal part, the first expandable metal sleeve having a first thickness, a first end and a second end, the first end of the expandable metal sleeve being connected with the outer face of the tubular metal part, a second expandable metal sleeve surrounding the tubular metal part, the second expandable metal sleeve having substantially the same thickness as the first expandable metal sleeve, and the second expandable metal sleeve having a first end connected with the outer face of the tubular metal part and a second end, wherein the annular barrier further comprises a first connecting sleeve having a second thickness being greater than the first thickness, the first connecting sleeve comprises a first sleeve end connected to the second end of the first expandable metal sleeve and a second sleeve end connected with the second end of the second expandable metal sleeve, and the annular barrier comprises an annular space defined between the tubular metal part, the first connecting sleeve and the expandable metal sleeves. The invention also relates to a downhole system comprising a plurality of the annular barriers and the well tubular metal structure.

20 Claims, 8 Drawing Sheets

(56) References Cited

U.S. PATENT DOCUMENTS

Figure 1:
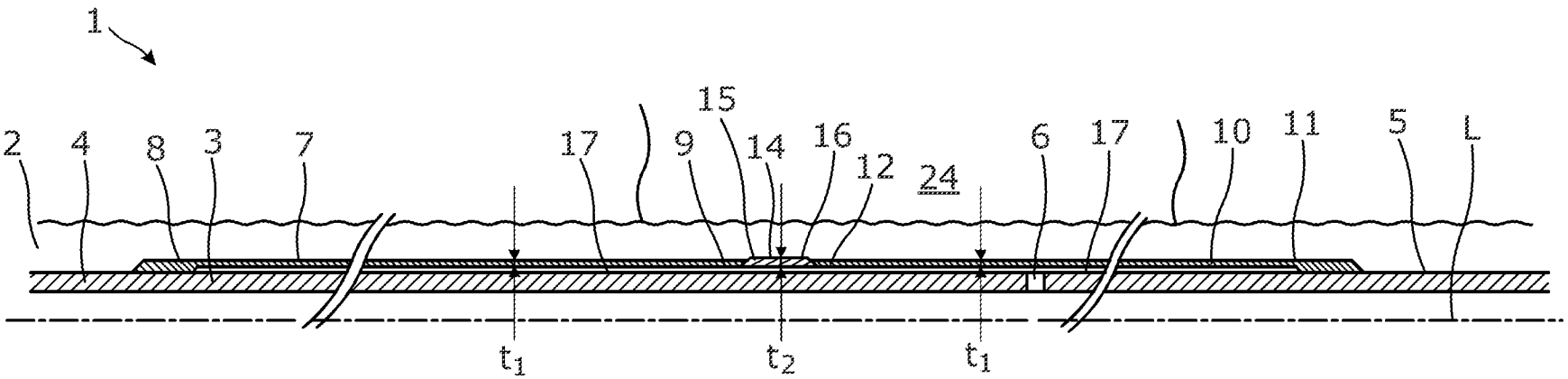

| | | | | |
|---|---|---|---|---|
| 10,844,686 | B2 * | 11/2020 | Hallundbæk | E21B 33/1277 |
| 2005/0072579 | A1 * | 4/2005 | Gambier | E21B 33/1277 166/387 |
| 2011/0297400 | A1 | 12/2011 | Pessin et al. | |
| 2019/0383114 | A1 * | 12/2019 | Vasques | E21B 33/1277 |
| 2020/0131881 | A1 * | 4/2020 | Vasques | E21B 33/1243 |
| 2020/0165892 | A1 * | 5/2020 | Vasques | E21B 33/128 |
| 2020/0408061 | A1 * | 12/2020 | Vasques | E21B 33/1277 |

* cited by examiner

ANNULAR BARRIER AND DOWNHOLE SYSTEM

This application claims priority to EP 21168969.0 filed Apr. 16, 2021 and EP 21206317.6 filed on Nov. 3, 2021, the entire contents of each of which are hereby incorporated by reference.

DESCRIPTION

The present invention relates to an annular barrier for providing isolation of a zone in a well having an isolation layer of less than 5 metres. The invention also relates to a downhole system comprising a plurality of such annular barriers and a well tubular metal structure.

Annular barriers are used downhole for providing isolation of one zone from another in an annulus in a borehole of a well between a well tubular metal structure and the borehole wall or another well tubular metal structure. When expanding annular barriers, it is important that the annular barriers are expanded to abut the inner face of the borehole or another well tubular metal structure to provide proper zonal isolation. Furthermore, the annular barrier needs to be expanded opposite the isolation layer between two zones in order to provide proper isolation of one zone from the other zone. In some boreholes, the isolation layer between two zones is very thin, e.g. only a few metres. In these wells, there is a need for a longer annular barrier so that the annular barrier is able to overlap the isolation layer since, when running the completion in hole, the precision may be up to 5-10 metres.

Annular barriers may have an expandable metal sleeve to be expanded opposite the isolation layer, and expandable metal sleeves having a length of more than 2 metres are difficult and expensive to make.

It is an object of the present invention to wholly or partly overcome the above disadvantages and drawbacks of the prior art. More specifically, it is an object to provide an improved annular barrier which is long enough to be set in wells with thin isolation layers while still being relatively easy to make without substantially increasing manufacturing costs as compared to annular barriers having 1-2-metre-long expandable metal sleeves.

Furthermore, it is an object to provide an improved annular barrier which is able to transfer more axial load from the well tubular metal structure to the borehole wall than in known solutions.

The above objects, together with numerous other objects, advantages and features, which will become evident from the below description, are accomplished by a solution in accordance with the present invention by an annular barrier for providing isolation of a zone in a well having an isolation layer of less than 5 metres, comprising:

- a tubular metal part configured to be mounted as part of a well tubular metal structure, the tubular metal part having an outer face, an opening and an axial extension along the well tubular metal structure,
- a first expandable metal sleeve surrounding the tubular metal part, the first expandable metal sleeve having a first thickness, a first end and a second end, the first end of the expandable metal sleeve being connected with the outer face of the tubular metal part, and
- a second expandable metal sleeve surrounding the tubular metal part, the second expandable metal sleeve having substantially the same thickness as the first expandable metal sleeve, and the second expandable metal sleeve having a first end connected with the outer face of the tubular metal part and a second end, wherein the annular barrier further comprises a first connecting sleeve having a second thickness being greater than the first thickness, the first connecting sleeve comprises a first sleeve end connected to the second end of the first expandable metal sleeve and a second sleeve end connected with the second end of the second expandable metal sleeve, and the annular barrier comprises an annular space defined between the tubular metal part, the first connecting sleeve and the expandable metal sleeves.

By having an annular barrier with two expandable metal sleeves and a thicker connecting sleeve, the expandable metal sleeves can be made having a length of 1-2 metres, which means that the annular barrier is easier and less costly to make than an annular barrier having one expandable metal sleeve with a length of 4 metres. The connecting sleeve is welded to the end of each expandable metal sleeve and in this way forms a common expandable metal sleeve. When expanding the expandable metal sleeves, the first and second expandable metal sleeves expand more than the connecting sleeve. In this way, the welded connections between the connecting sleeve and the expandable metal sleeves are only slightly expanded, and the welded connections are less likely to break compared to a solution where the expandable metal sleeves are directly connected by welding.

The connecting sleeve is thicker than the expandable metal sleeves, ensuring that the welded connections between the connecting sleeve and the expandable metal sleeves are not expanded to the same extent as a middle part of the expandable metal sleeves. Thus, the modular sleeve of the annular barrier can be made as long as required, and even though the isolation layer is merely 2 metres thick, and the precision of the completion procedure only results in a positioning of the annular barrier within 6 metres, part of the annular barrier still overlaps the isolation layer, and sufficient isolation of the zone is obtained.

Moreover, the first expandable metal sleeve and the second expandable metal sleeve may comprise projections creating a third thickness, and the first thickness may be smaller than the third thickness.

Further, the first connecting sleeve may have a varying thickness, and the second thickness of the first connecting sleeve may be the largest thickness of the first connecting sleeve.

Also, the annular barrier may further comprise a support structure connecting the first connecting sleeve with the tubular metal part so as to transfer load from the tubular metal part to the first and second expandable metal sleeves.

In addition, the support structure may have a first state in which the support structure has a first radial extension in a radial direction to the axial extension, and the support structure has a second state in which the support structure has a second radial extension in the radial direction to the axial extension, the second radial extension being greater than the first radial extension.

Furthermore, the first state may be an unexpanded condition of the annular barrier, and the second state may be an expanded condition of the annular barrier.

Moreover, the support structure may comprise the first connecting sleeve, a connecting part and a connecting element connecting the first connecting sleeve and the connecting part, the connecting part being fixedly connected to the tubular metal part.

Further, the connecting element may be expandable in the radial direction to the axial extension. In this way, the supporting structure is capable of expanding with the expandable metal sleeves while being fastened to the tubular metal part to transfer the axial load.

Also, the connecting element may be pivotably connected to the first connecting sleeve and to the connecting part.

Moreover, the connecting element may have a flexible configuration.

Further, the connecting element may be more flexible than the connecting part.

Also, the connecting element may have a compressed state in the unexpanded condition of the annular barrier and a less compressed state in the expanded condition of the annular barrier.

In addition, the connecting element may have a cross-sectional shape being an S-shape, a C-shape or a Z-shape.

Furthermore, the connecting part may be permanently fixed to the tubular metal part.

Additionally, the supporting structure may be made as one monolithic whole so that the connecting element, the connecting sleeve and the connecting part are made as one monolithic whole.

Moreover, the connecting part may be welded or crimped onto the tubular metal part.

Also, the connecting part may remain unexpanded during expansion of the expandable metal sleeves.

Further, the connecting part may have a fixed inner diameter and/or a fixed outer diameter.

Also, the connecting sleeve may be fixedly connected to the connecting part in an axial direction and movably connected in relation to the connecting part in the radial direction.

By being movably connected in relation to the connecting part in the radial direction and thus being able to uncompress, unfold or straighten, the connecting element enables the expansion of the expandable metal sleeves without jeopardizing the supporting ability of the supporting structure.

In addition, the connecting part may have a tubular shape.

Furthermore, the connecting element may have an element length along the axial extension, and the connecting part may have a part length along the axial extension.

Moreover, the element length may be substantially the same as the part length.

Further, the connecting part may have an outer face groove in which part of the connecting element engages and/or the connecting sleeve may have an inner face groove in which part of the connecting element engages.

Also, the first sleeve end may be welded to the second end of the first expandable metal sleeve, and the second sleeve end may be welded to the second end of the second expandable metal sleeve.

Furthermore, the annular barrier may also comprise a third expandable metal sleeve surrounding the tubular metal part, the third expandable metal sleeve having the same thickness as the first expandable metal sleeve, the third expandable metal sleeve having a first end connected with the second sleeve end of the first connecting sleeve and a second end, and the annular barrier further comprising a second connecting sleeve having the second thickness, the second connecting sleeve comprising a first sleeve end connected with the second end of the third expandable metal sleeve and a second sleeve end connected with the second end of the second expandable metal sleeve so that the second sleeve end is connected with the second end of the second expandable metal sleeve by means of the third expandable metal sleeve and the second connecting sleeve, and the annular space being defined between the tubular metal part, the first and second connecting sleeves and the expandable metal sleeves.

Also, the annular barrier may further comprise a fourth expandable metal sleeve surrounding the tubular metal part, the fourth expandable metal sleeve having the same thickness as the first expandable metal sleeve, the fourth expandable metal sleeve having a first end connected with the second sleeve end of the second connecting sleeve and a second end, and a third connecting sleeve having the second thickness, the third connecting sleeve comprising a first sleeve end connected with the second end of the third expandable metal sleeve and a second sleeve end connected with the second end of the second expandable metal sleeve so that the second sleeve end is connected with the second end of the second expandable metal sleeve by means of the third and fourth expandable metal sleeves and the second and third connecting sleeves, and the annular space being defined between the tubular metal part, the connecting sleeves and the expandable metal sleeves.

In addition, the annular barrier may further comprise a tube extending through the annular space, through the connection of the first end of the first expandable metal sleeve to the tubular metal part and through the connection of the second end of the second expandable metal sleeve to the tubular metal part, providing a flow channel through the annular barrier in an expanded condition.

Further, the annular barrier may also comprise at least one tubular connection part for connecting the end of the expandable metal sleeve to the outer face of the tubular metal part.

Moreover, the tubular connection part may comprise a projecting flange overlapping the end of the expandable metal sleeve.

Furthermore, the annular barrier may also comprise a valve assembly fluidly connected to the opening and the annular space.

Additionally, the connecting sleeve may partly overlap the ends of the expandable metal sleeves.

Also, the first and second sleeve ends of the connecting sleeve may comprise a projecting sleeve flange, each projecting sleeve flange overlapping one of the ends of the expandable metal sleeve.

In addition, the first ends of the first and second expandable metal sleeves may have an increased thickness for connecting to the tubular metal part. In that way, there is no need for separate connection parts.

Further, the second thickness may be at least 5% thicker than the first thickness, preferably at least 10% thicker than the first thickness, and more preferably at least 15% thicker than the first thickness.

Moreover, the first expandable metal sleeve and the second expandable metal sleeve may have a length along the axial extension being at least 50% longer than a length of the connecting sleeve, preferably at least 60% longer than a length of the connecting sleeve, and more preferably 75% longer than a length of the connecting sleeve.

Furthermore, the annular barrier may also comprise at least one annular sealing element arranged on an outer face of the expandable metal sleeves.

Also, the annular sealing element may be arranged in a first circumferential groove.

In addition, the circumferential groove may be formed between two projections.

Furthermore, the annular sealing element may be supported by a back-up sealing element.

Moreover, the annular barrier may also comprise a key ring element surrounding at least part of the back-up sealing element.

Further, the annular barrier may also comprise a second back-up sealing element arranged so that the annular sealing element is between the two back-up sealing elements when seen along the axial extension.

Also, the expandable metal sleeve may comprise a second circumferential groove.

In addition, the second circumferential groove may comprise a groove element.

Moreover, the groove element may be made of Polytetrafluoroethylene (PTFE) or rubber.

Furthermore, the back-up sealing element may be made of Polytetrafluoroethylene (PTFE).

Moreover, the key ring element may be made of metal such as spring steel.

Further, the annular sealing element may be made of rubber or elastomer.

Also, one of the first ends of the first and/or second expandable metal sleeves may be welded to the outer face of the tubular metal part.

In addition, the invention relates to a downhole system comprising a plurality of the annular barriers and the well tubular metal structure.

Finally, the downhole system may further comprise at least one inflow valve between two annular barriers.

Figure 2:
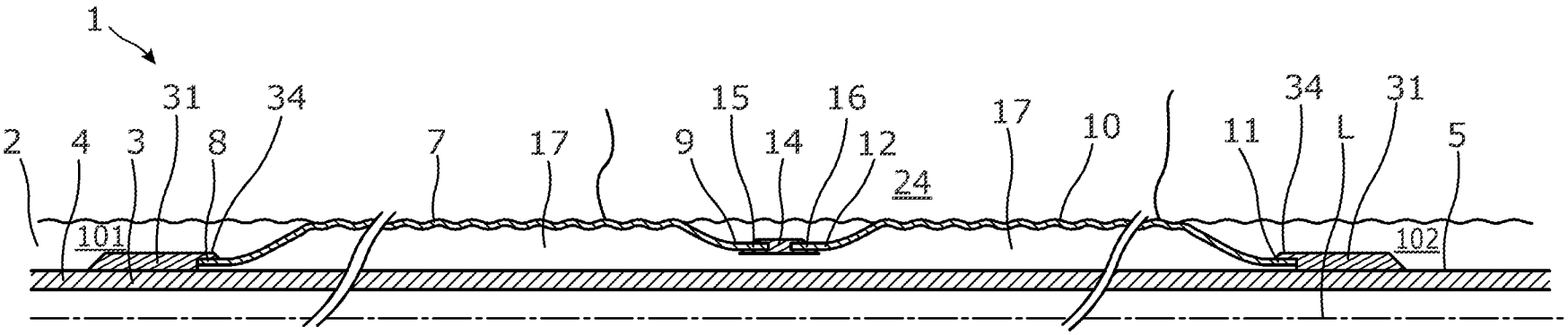
Figure 3:
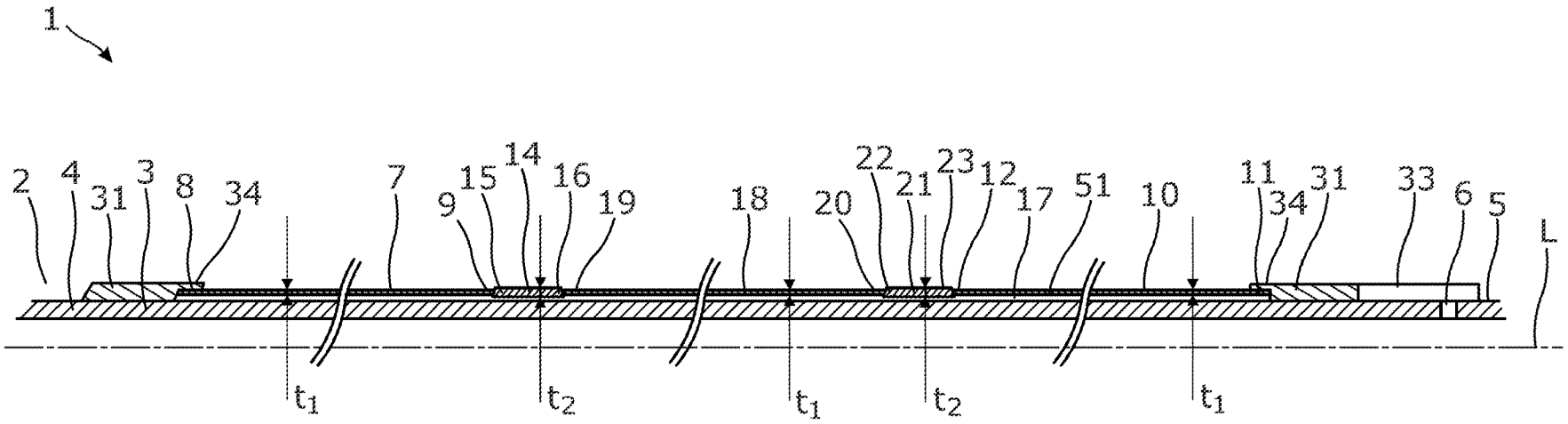
Figure 4:
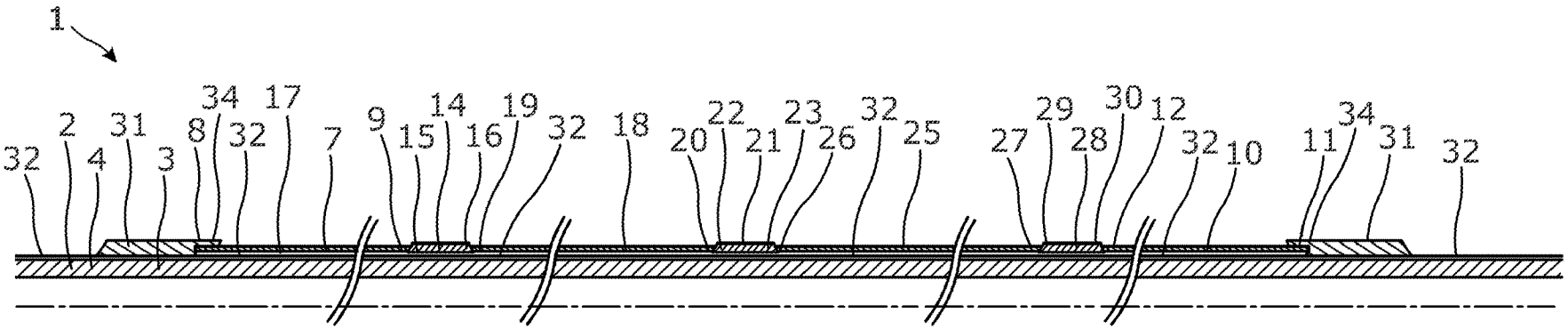
Figure 5:
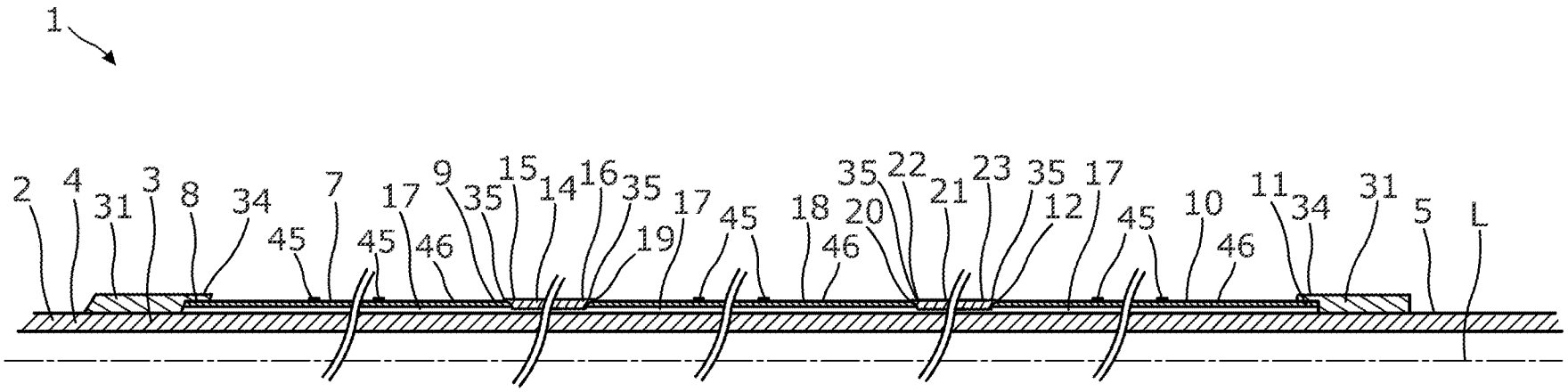
Figure 6:
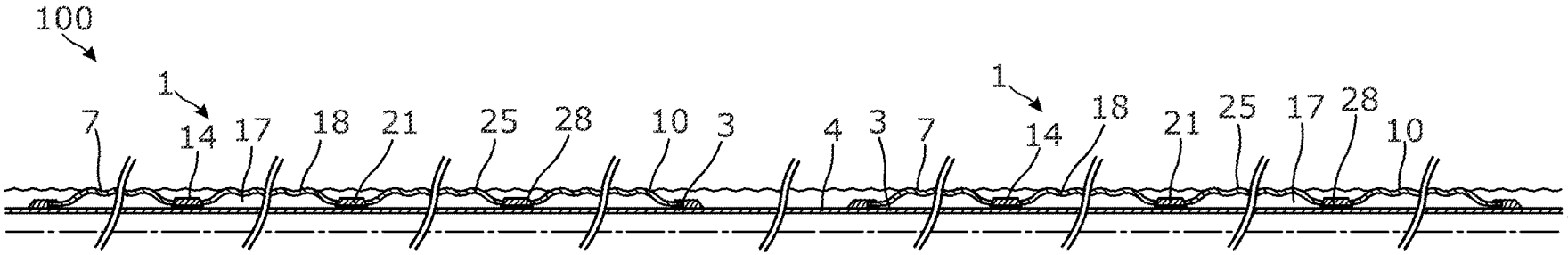
Figure 7:
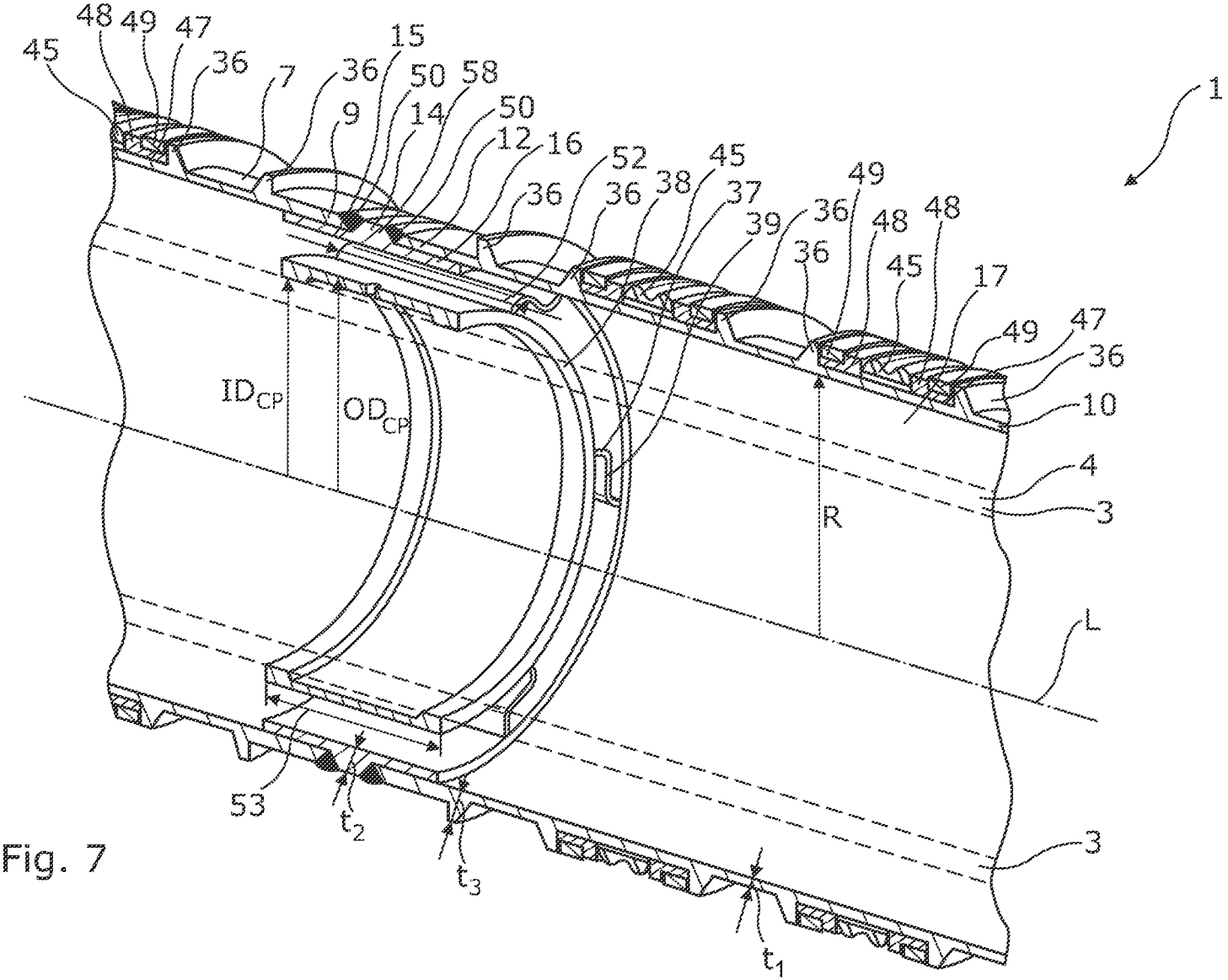
Figure 8:
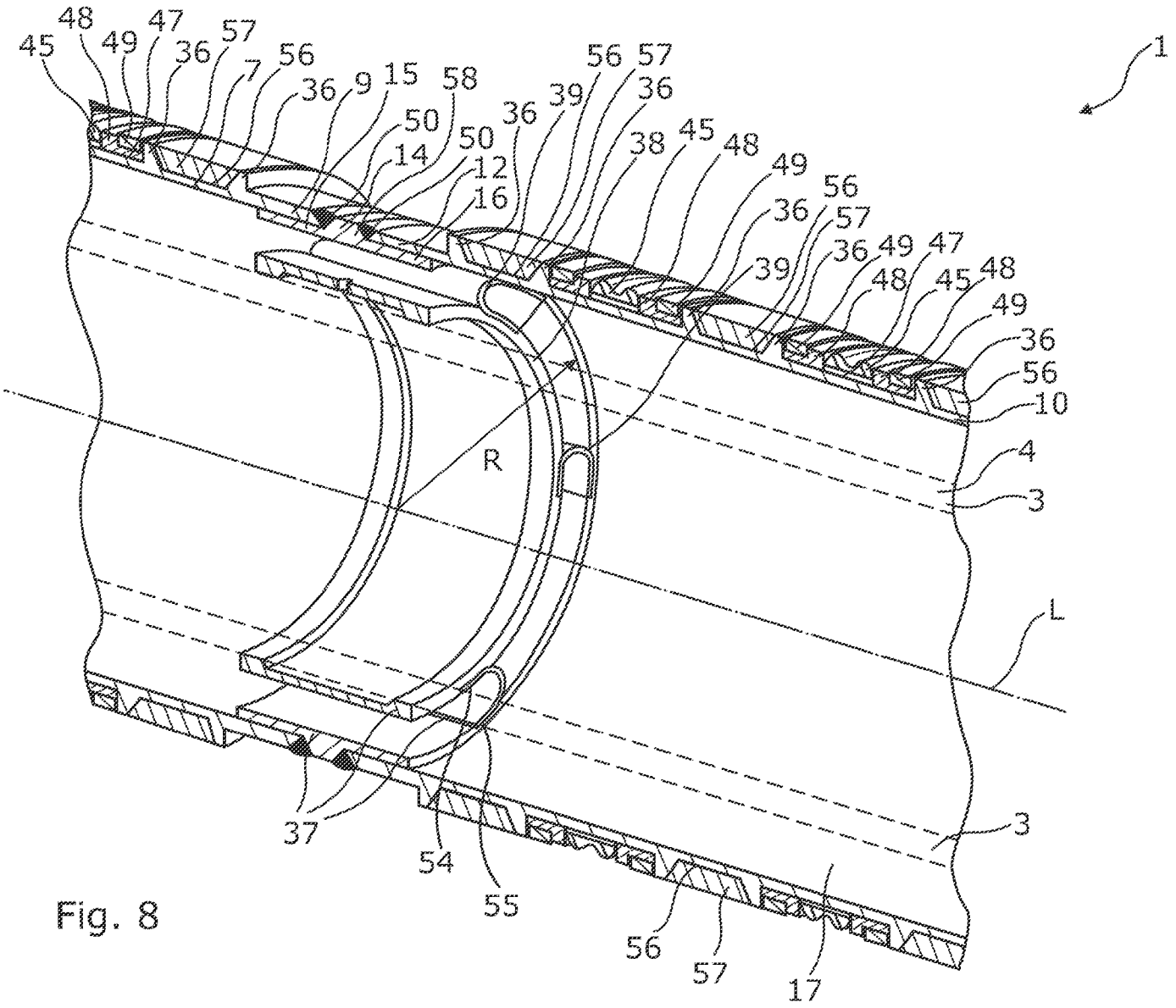

The invention and its many advantages will be described in more detail below with reference to the accompanying schematic drawings, which for the purpose of illustration show some non-limiting embodiments and in which:

FIG. 1 shows a cross-sectional view of an annular barrier having two expandable metal sleeves and one connecting sleeve in its unexpanded condition, FIG. 2 shows a cross-sectional view of another annular barrier having two expandable metal sleeves and one connecting sleeve in its expanded condition, FIG. 3 shows a cross-sectional view of another annular barrier having three expandable metal sleeves and two connecting sleeves in their unexpanded condition, FIG. 4 shows a cross-sectional view of another annular barrier having four expandable metal sleeves and three connecting sleeves in their unexpanded condition, FIG. 5 shows a cross-sectional view of another annular barrier having three expandable metal sleeves and two connecting sleeves in their unexpanded condition, FIG. 6 shows a cross-sectional view of a downhole system having two annular barriers, FIG. 7 shows a cross-sectional view of another annular barrier having two expandable metal sleeves and one connecting sleeve, the annular barrier being in its unexpanded condition and having a support structure for transferring axial load from the well tubular metal structure and thus the tubular metal part to the expandable metal sleeves, and FIG. 8 shows a cross-sectional view of another annular barrier having two expandable metal sleeves and one connecting sleeve, the annular barrier being in its unexpanded condition and having another support structure for transferring axial load from the well tubular metal structure and thus the tubular metal part to the expandable metal sleeves.

All the figures are highly schematic and not necessarily to scale, and they show only those parts which are necessary in order to elucidate the invention, other parts being omitted or merely suggested.

FIG. 1 shows an annular barrier 1 for providing isolation of a zone in a well 2 having a thin isolation layer 24 of less than 5 metres. The annular barrier 1 comprises a tubular metal part 3 mounted as part of a well tubular metal structure 4. The tubular metal part 3 has an outer face 5, an opening 6 and an axial extension L along the well tubular metal structure 4. The annular barrier 1 comprises a first expandable metal sleeve 7 surrounding the tubular metal part 3. The first expandable metal sleeve 7 has a first thickness $t_1$, a first end 8 and a second end 9. The first end 8 of the expandable metal sleeve 7 is connected with the outer face 5 of the tubular metal part 3. The annular barrier 1 further comprises a second expandable metal sleeve 10 surrounding the tubular metal part 3. The second expandable metal sleeve 10 has the same thickness as the first expandable metal sleeve 7. The second expandable metal sleeve 10 has a first end 11 connected with the outer face 5 of the tubular metal part 3 and a second end 12. The annular barrier 1 comprises a first connecting sleeve 14 having a second thickness t2 being greater than the first thickness $t_1$. The first connecting sleeve 14 comprises a first sleeve end 15 connected to the second end 9 of the first expandable metal sleeve 7 and a second sleeve end 16 connected with the second end 12 of the second expandable metal sleeve 10. The annular barrier 1 further comprises an annular space 17 defined between the tubular metal part 3, the first connecting sleeve 14 and the expandable metal sleeves 7, 10.

By having an annular barrier 1 with two expandable metal sleeves 7, 10 and a thicker connecting sleeve 14, the expandable metal sleeves 7, 10 can be made having a length of 1-2 metres, which means that the annular barrier is easier and less costly to make than an annular barrier having one expandable metal sleeve with a length of 4 metres. The connecting sleeve 14 is welded to the ends of each expandable metal sleeve 7, 10 and in this way, forms a common expandable metal sleeve. As can be seen in FIG. 2, the first and second expandable metal sleeves 7, 10 expand more than the connecting sleeve 14, and in this way, the welded connections between the connecting sleeve 14 and the expandable metal sleeves 7, 10 are only slightly expanded in a radial direction perpendicular to the axial extension and are less likely to break than if the connecting sleeve 14 was expanded as much as a middle part of the expandable metal sleeves 7, 10. The connecting sleeve 14 is thicker than the expandable metal sleeves 7, 10, ensuring that the welded connections between the connecting sleeve 14 and the expandable metal sleeves 7, 10 are not expanded as much as the middle part of the expandable metal sleeves 7, 10. Thus, the modular sleeve of the annular barrier 1 can be made as long as required, e.g. 8-10 metres, and even though the isolation layer 24 is merely 2 metres thick, i.e. 2 metres along the axial extension, and the precision of the completion procedure only results in a positioning of the annular barrier 1 within 6 metres, part of the annular barrier 1 is still overlapping the isolation layer 24, and sufficient isolation of the zone is obtained.

The first sleeve end 15 of the first connecting sleeve 14 is welded to the second end 9 of the first expandable metal sleeve 7, and the second sleeve end 16 of the first connecting sleeve 14 is welded to the second end 12 of the second expandable metal sleeve 10 so as to form one common sleeve. The first ends of the expandable metal sleeves 7, 10 may have an increased thickness and may be crimped onto the tubular metal part 3 or welded to the tubular metal part 3, as shown in FIG. 1. The opening in the tubular metal part 3 is arranged opposite the annular space 17. The first expandable metal sleeve 7 and the second expandable metal sleeve 10 have the same length along the axial extension, and the first connecting sleeve 14 is arranged in between the expandable metal sleeves 7, 10 and welded to their ends.

In FIG. 2, the expandable metal sleeves 7, 10 are expanded so that a middle part thereof abuts the wall of the borehole and conforms to its shape thereto. In another embodiment, the expandable metal sleeves 7, 10 are expanded so that a middle part thereof abuts the wall of another well tubular metal structure. The expanded annular barrier 1 isolates a first zone 101 from a second zone 102. The first ends 8, 11 of the expandable metal sleeves 7, 10 are connected to the outer face 5 of the tubular metal part 3 by means of a tubular connection part 31. Each tubular connection part 31 comprises a projecting flange 34 overlapping the first ends 8, 11 of the expandable metal sleeves 7, 10 so as to limit the free expansion of the ends of the expandable metal sleeves 7, 10, and thereby the connection between the ends of the expandable metal sleeves 7, 10, and the tubular connection part 31 is not jeopardized, nor is the welded connection broken if welding is used. In FIG. 2, the ends of the expandable metal sleeves 7, 10 engage grooves in the connecting sleeve 14 besides being welded together.

In FIG. 3, the annular barrier 1 comprises a third expandable metal sleeve 18 surrounding the tubular metal part 3 and arranged between the first expandable metal sleeve 7 and the second expandable metal sleeve 10 along the axial extension L. The third expandable metal sleeve 18 has the same thickness as the first expandable metal sleeve 7. The third expandable metal sleeve 18 has a first end 19 connected with the second sleeve end 16 of the first connecting sleeve 14 and a second end 20 connected to a second connecting sleeve 21. The second connecting sleeve 21 has the same second thickness t2 as the first connecting sleeve 14. The second connecting sleeve 21 comprises a first sleeve end 22 connected with the second end 20 of the third expandable metal sleeve 18 and a second sleeve end 23 connected with the second end 12 of the second expandable metal sleeve 10 so that the second sleeve end 16 is connected with the second end 12 of the second expandable metal sleeve 10 by means of the third expandable metal sleeve 18 and the second connecting sleeve 21. In this aspect, the annular space 17 is defined between the tubular metal part 3, the first and second connecting sleeves 14, 21 and the expandable metal sleeves 7, 10, 18. By having three expandable metal sleeves 7, 10, 18 of 2 metres connected by means of thicker connecting sleeves 14, 21, the annular barrier 1 can be made at least 6 metres long in an easy and modularized design only requiring short expandable metal sleeves which are easy to manufacture.

As can be seen in FIG. 3, the connecting sleeves 14, 21 provide a distance from an inner face 51 of the expandable metal sleeves 7, 10, 18 and the outer face 5 of the tubular metal part 3 since the connecting sleeves 14, 21 have a greater thickness than that of the expandable metal sleeves 7, 10, 18. In that way, the connecting sleeves 14, 21 support the expandable metal sleeves 7, 10, 18 so that they do not collapse during the submerging of the well tubular metal structure 4 into the borehole as the pressure increases down the hole.

The annular barrier 1 shown in FIG. 3 further comprises a valve assembly 33 fluidly connected to the opening 6 in the tubular metal part and the annular space 17. The opening 6 is positioned offset from the annular space 17 along the axial extension so that fluid enters the valve assembly 33 before entering the annular space 17. The valve assembly 33 may have a variety of designs. One aspect of a valve assembly has a first position providing fluid communication between the opening and the annular space 17 and a second position after expansion of the annular barrier where this fluid communication is closed. In another aspect of the valve assembly, the first position is the same, but in the second position fluid communication from the opening is closed, and there is fluid communication to the outside of the expanded annular barrier, i.e. to the first zone 101 or the second zone 102. By providing fluid communication between the annular space 17 and one of the zones after expansion, the pressure in the annular space 17 can be equalised with the pressure in the zone so as to avoid collapsing of the annular barrier 1 if the outside pressure increases, and in this way the collapse rating of the annular barrier 1 is increased.

In FIG. 4, the annular barrier 1 further comprises a fourth expandable metal sleeve 25 surrounding the tubular metal part 3. The fourth expandable metal sleeve 25 has the same first thickness $t_1$ as the first expandable metal sleeve 7 (shown in FIGS. 1 and 3). The fourth expandable metal sleeve 25 has a first end 26 connected with the second sleeve end 23 of the second connecting sleeve 21 and a second end 27. The annular barrier 1 also comprises a third connecting sleeve 28 having the same second thickness t2 as the first and second connecting sleeves 14, 21. The third connecting sleeve 28 comprises a first sleeve end 29 connected with the second end 27 of the fourth expandable metal sleeve 25 and a second sleeve end 30 connected with the second end 12 of the second expandable metal sleeve 10 so that the second sleeve end 16 is connected with the second end 12 of the second expandable metal sleeve 10 by means of the third and fourth expandable metal sleeves 18, 25 and the second and third connecting sleeves 21, 28. The annular space 17 is defined between the tubular metal part 3, the connecting sleeves 14, 21, 28 and the expandable metal sleeves 7, 10, 18, 25. By having four expandable metal sleeves of 2 metres connected by means of three thicker connecting sleeves 14, 21, 28, the annular barrier 1 can be made at least 8 metres long in an easy and modularized design only requiring short expandable metal sleeves which are easy to manufacture. If the connecting sleeves 14, 21, 28 are made having a length of 0.5 metres, the length of the annular barrier 1 will be 10 metres, and in this way, the annular barrier 1 can be made having the required length to ensure that the isolation layer is sufficiently overlapped.

Such long annular barriers can also be used to support a porous wall/formation so that the expanded annular barrier supports the wall of the borehole to prevent it from deteriorating, collapsing and interfering with the production as fluid from the zones would then be mixed as the zone isolation is destroyed.

The connecting sleeves 14, 21, 28 are thicker than the expandable metal sleeves 7, 10, 18, 25, i.e. the second thickness t2 may be at least 5% thicker than the first thickness $t_1$, preferably at least 10% thicker than the first thickness $t_1$, and more preferably at least 15% thicker than the first thickness $t_1$. Furthermore, the expandable metal sleeves 7, 10, 18, 25 are longer than the connecting sleeves 14, 21, 28, and thus the first expandable metal sleeve 7 and the second expandable metal sleeve 10 have a length along the axial extension L being at least 50% longer than a length of the connecting sleeve, preferably at least 60% longer than a length of the connecting sleeve, and more preferably 75% longer than a length of the connecting sleeve.

In FIG. 4, the annular barrier 1 further comprises a tube 32 extending underneath the common sleeve provided by the expandable metal sleeves 7, 10, 18, 25 welded together with the connecting sleeves 14, 21, 28. The tube 32 extends through the annular space 17, through the connection of the first end 8 of the first expandable metal sleeve 7 to the tubular metal part 3 and through the connection of the second end 12 of the second expandable metal sleeve 10 to the tubular metal part 3. The tube 32 thus provides a flow channel through the annular barrier 1 in an expanded condition. In FIG. 4, the annular barrier 1 has two connection parts 31 connecting the first ends 8, 11 of the first and second expandable metal sleeves 7, 10 to the outer face 5 of the tubular metal part 3, and the tube 32 extends through both connection parts 31. In another aspect of the invention (not shown), the flow through the annular barrier is provided by a thin sleeve arranged between the expandable metal sleeves and the tubular metal part so that the fluid channel is annular as the thin sleeve extends all the way around the tubular metal part, and the fluid channel through the annular barrier is the annular channel between the thin sleeve and the outer face of the tubular metal part.

The annular barrier 1 of FIG. 5 comprises three expandable metal sleeves 7, 10, 18 connected by welding by means of intermediate connecting sleeves 14, 21. The first and second sleeve ends 15, 16 of each connecting sleeve 14, 21 comprise a projecting sleeve flange 35 overlapping one of the ends of the expandable metal sleeve. Thereby, the expandable metal sleeves 7, 10, 18 are prevented from expanding freely in the same way as the projecting flange 34 of the connection parts 31, and in this way the welded connections are protected during the expansion of the expandable metal sleeves 7, 10, 18 so that the welded connections do not break during expansion. The annular barrier 1 further comprises some sealing elements 45 arranged on the outer face 46 of the expandable metal sleeves 7, 10, 18 in order to increase the isolation ability of the annular barrier 1.

In FIG. 6, a downhole system 100 comprising a plurality of the annular barriers 1 and the well tubular metal structure 4 is shown. In order to isolate a zone, two annular barriers 1 are needed. The downhole system 100 further comprises at least one inflow valve between two annular barriers 1 in order to let formation fluid into the well tubular metal structure 4 in a controlled manner.

The annular barrier 1 is expanded by means of pressurised fluid let into the opening and further into the annular space 17 in order to expand the expandable metal sleeve 7, 10, 18, 25 to abut the wall of the borehole. The pressurised fluid is generated either by a pump at the surface pumping fluid down some tubing/well tubular metal structure 4 or by a pump in a tool which isolates a part of the well tubular metal structure 4 opposite the opening.

In FIGS. 7 and 8, the first expandable metal sleeve 7 and the second expandable metal sleeve 10 comprise projections 36 creating a third thickness t3, and the first thickness $t_1$ is smaller than the third thickness t3. The first thickness $t_1$ is also smaller than the second thickness t2. The connecting sleeve 14, 21 has a varying thickness, and the second thickness t2 of the connecting sleeve 14, 21 is the largest thickness and overall thickness of the first connecting sleeve 14 and the second connecting sleeve 21. The annular barrier 1 further comprises a support structure 37 connecting the connecting sleeve 14 with the tubular metal part 3 so as to transfer load from the tubular metal part 3 to the first and second expandable metal sleeves 7, 10. Thus, the support structure 37 connecting the connecting sleeve 14 with the tubular metal part 3 transfers axial load from the well tubular metal structure 4 which the tubular metal part 3 forms part of to the expandable metal sleeves 7, 10 and thus to the formation on which the expandable metal sleeves 7, 10 abut in their expanded position or state.

The well tubular metal structure 4 is heavy, and by having a supporting structure 37 more load from that weight can be transferred to the expanded expandable metal sleeves 7, 10 and thereby to the borehole wall. If the annular barrier has no intermediate supporting structure, the axial load can only be transferred via the ends of the annular barrier, and in the event that the annular barrier has a long sleeve section of several expandable metal sleeves, the annular barrier is not able to transfer a high axial load compared to an annular barrier having one or more supporting structures intermediate to the ends of the annular barrier. The first ends of the first and second expandable metal sleeves may be connected directly to the tubular metal part or via connection parts, and without the supporting structure the axial load can only be transferred via the first ends. By having 1-metre-long expandable metal sleeves connected by connecting sleeves, and each connecting sleeve forming part of the supporting structure, the annular barrier can be made to transfer a very high axial load compared to an annular barrier having one long unsupported expandable metal sleeve or two longer unsupported expandable metal sleeves. Thus, the annular barrier having more than two expandable metal sleeves may comprise more than one supporting structure at each connecting sleeve.

In order to transfer axial load after expansion of the expandable metal sleeves 7, 10, the support structure 37 has a first state in which the support structure 37 has a first radial extension in a radial direction R to the axial extension L, as shown in FIGS. 7 and 8, and the support structure 37 has a second state in which the support structure 37 has a second radial extension in the radial direction R to the axial extension L, where the second radial extension is greater than the first radial extension. The first state is an unexpanded condition of the annular barrier 1, and the second state is an expanded condition of the annular barrier 1.

As shown in FIGS. 7 and 8, the support structure 37 comprises the first connecting sleeve 14, a connecting part 38 and a connecting element 39, where the connecting element 39 connects the first connecting sleeve 14 and the connecting part 38, and the connecting part 38 is fixedly connected to the tubular metal part 3 both along the axial extension L and in the radial direction R radially to the axial extension L. The connecting part 38 remains substantially unexpanded during expansion of the expandable metal sleeves 7, 10 and has a fixed inner diameter $ID_{CP}$ and a fixed outer diameter $OD_{CP}$. The connecting part 38 may be welded or crimped onto the tubular metal part 3 to fixate the connecting part 38. Thus, the connecting part 38 is permanently fixed to the tubular metal part 3. The connecting element 39 is expandable in the radial direction R, i.e. a direction being radial to the axial extension L, and in this way, the supporting structure 37 is capable of expanding with the expandable metal sleeves 7, 10 while being fastened to the tubular metal part 3 to transfer the axial load. Thus, the connecting element 39 has a flexible configuration, and the connecting element 39 is more flexible than the connecting part 38. The connecting element 39 has a compressed state in the unexpanded condition of the annular barrier 1, as shown in FIGS. 7 and 8, and a less compressed state in the expanded condition of the annular barrier 1 (not shown), in which less compressed state the connecting element 39 has partly unfolded or straightened more out in the radial direction R. By being able to uncompress, unfold or straighten, the connecting element 39 enables the expansion of the expandable metal sleeves 7, 10 without jeopardizing the supporting ability of the supporting structure 37. In FIG. 7, the connecting element 39 has a cross-sectional shape being an S-shape, and in FIG. 8, the connecting element 39 has a cross-sectional shape being a C-shape. In another embodiment, the connecting element 39 has a different cross-sectional shape being able to unfold or straighten out during expansion of the expandable metal sleeves 7, 10, e.g. a Z-shape. The connecting element 39 may be pivotably connected to the first connecting sleeve 14 and to the connecting part 38, e.g. at the ends of the "C", the ends of the "5" or the ends of the "Z". The connecting element 39 may be welded to the connecting part 38 and the connecting sleeve 14, or the supporting structure 37 may be made as one monolithic whole so that the connecting element 39, the connecting sleeve 14 and the connecting part 38 is made as one monolithic whole.

In FIGS. 7 and 8, the connecting sleeve 14 is fixedly connected to the connecting part 38 in an axial direction L along the radial extension and movably connected in relation to the connecting part 38 in the radial direction R. As can be seen, the connecting part 38 has a tubular shape surrounding the tubular metal part 3. As shown in FIG. 7, the connecting element 39 has an element length 52 along the axial extension L, and the connecting part 38 has a part length 53 along the axial extension L. The element length is substantially the same as the part length. In FIG. 8, the connecting part 38 has an outer face groove 54 in which part of the connecting element 39 engages, and the connecting sleeve 14 has an inner face groove 55 in which part of the connecting element 39 engages.

The connecting sleeve 14 partly overlaps the ends of the expandable metal sleeves 7, 10. In FIGS. 7 and 8, the connecting sleeve 14 has a circumferential sleeve projection 58, and the ends of the expandable metal sleeves 7, 10 abut the circumferential sleeve projection 58 and are welded to the connecting sleeve 14 by a welded connection 50. The annular sealing element 45 is arranged in a first circumferential groove 47, and the circumferential groove 47 is formed between two projections 36. The annular sealing element 45 is supported by a back-up sealing element 48 on one side and a second back-up sealing element 48 on the other side arranged so that the annular sealing element 45 is between the two back-up sealing elements 48 when seen along the axial extension L. A key ring element 49 surrounds at least part of each back-up sealing element 48. The back-up sealing elements 49 may be made of Polytetrafluoroethylene (PTFE). The key ring element 49 may be made of metal such as spring steel, and the annular sealing element 45 may be made of rubber or elastomer.

In FIG. 8, the expandable metal sleeves 7, 10 comprise a second circumferential groove 56 filled with a groove element 57. The groove element 57 may be made of Polytetrafluoroethylene (PTFE) or rubber.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. An annular barrier for providing isolation of a zone in a well having an isolation layer of less than 5 metres, comprising:

a tubular metal part configured to be mounted as part of a well tubular metal structure, the tubular metal part having an outer face, an opening and an axial extension along the well tubular metal structure, a first expandable metal sleeve surrounding the tubular metal part, the first expandable metal sleeve having a first thickness, a first end and a second end, the first end of the expandable metal sleeve being connected with the outer face of the tubular metal part, and a second expandable metal sleeve surrounding the tubular metal part, the second expandable metal sleeve having substantially the same thickness as the first expandable metal sleeve, and the second expandable metal sleeve having a first end connected with the outer face of the tubular metal part and a second end, wherein the annular barrier further comprises a first connecting sleeve having a second thickness being greater than the first thickness, the first connecting sleeve comprises a first sleeve end connected to the second end of the first expandable metal sleeve and a second sleeve end connected with the second end of the second expandable metal sleeve, and the annular barrier comprises an annular space defined between the tubular metal part, the first connecting sleeve and the expandable metal sleeves.

2. The annular barrier according to claim 1, wherein the first expandable metal sleeve and the second expandable metal sleeve comprise projections creating a third thickness, and the first thickness is smaller than the third thickness.

3. The annular barrier according to claim 1, wherein the first connecting sleeve has a varying thickness, and the second thickness of the first connecting sleeve is the largest thickness of the first connecting sleeve.

4. The annular barrier according to claim 1, further comprising a support structure connecting the first connecting sleeve with the tubular metal part so as to transfer load from the tubular metal part to the first and second expandable metal sleeves.

5. The annular barrier according to claim 4, wherein the support structure has a first state in which the support structure has a first radial extension in a radial direction to the axial extension, and the support structure has a second state in which the support structure has a second radial extension in the radial direction to the axial extension, the second radial extension being greater than the first radial extension.

6. The annular barrier according to claim 4, wherein the support structure comprises the first connecting sleeve, a connecting part and a connecting element connecting the first connecting sleeve and the connecting part, the connecting part being fixedly connected to the tubular metal part.

7. The annular barrier according to claim 6, wherein the connecting element is expandable in the radial direction to the axial extension.

8. The annular barrier according to claim 6, wherein the connecting element has a cross-sectional shape being an S-shape, a C-shape or a Z-shape.

9. The annular barrier according to claim 6, wherein the connecting part is permanently fixed to the tubular metal part.

10. The annular barrier according to claim 6, wherein the connecting sleeve is fixedly connected to the connecting part in an axial direction and movably connected in relation to the connecting part in the radial direction.

11. The annular barrier according to claim 1, further comprising a third expandable metal sleeve surrounding the tubular metal part, the third expandable metal sleeve having the same thickness as the first expandable metal sleeve, the third expandable metal sleeve having a first end connected with the second sleeve end of the first connecting sleeve and a second end, and the annular barrier further comprising a second connecting sleeve having the second thickness, the second connecting sleeve comprising a first sleeve end connected with the second end of the third expandable metal sleeve and a second sleeve end connected with the second end of the second expandable metal sleeve so that the second sleeve end is connected with the second end of the second expandable metal sleeve by means of the third expandable metal sleeve and the second connecting sleeve, and the annular space being defined between the tubular metal part, the first and second connecting sleeves and the expandable metal sleeves.

12. The annular barrier according to claim 1, further comprising a fourth expandable metal sleeve surrounding the tubular metal part, the fourth expandable metal sleeve having the same thickness as the first expandable metal sleeve, the fourth expandable metal sleeve having a first end connected with the second sleeve end of the second connecting sleeve and a second end, and a third connecting sleeve having the second thickness, the third connecting sleeve comprising a first sleeve end connected with the second end of the third expandable metal sleeve and a second sleeve end connected with the second end of the second expandable metal sleeve so that the second sleeve end is connected with the second end of the second expandable metal sleeve by means of the third and fourth expandable metal sleeves and the second and third connecting sleeves, and the annular space being defined between the tubular metal part, the connecting sleeves and the expandable metal sleeves.

13. The annular barrier according to claim 1, further comprising a tube extending through the annular space, through the connection of the first end of the first expandable metal sleeve to the tubular metal part and through the connection of the second end of the second expandable metal sleeve to the tubular metal part, providing a flow channel through the annular barrier in an expanded condition.

14. The annular barrier according to claim 1, wherein the tubular connection part comprises a projecting flange overlapping the end of the expandable metal sleeve.

15. The annular barrier according to claim 1, wherein the first and second sleeve ends of the connecting sleeve comprise a projecting sleeve flange, each projecting sleeve flange overlapping one of the ends of the expandable metal sleeve.

16. The annular barrier according to claim 1, wherein the first ends of the first and second expandable metal sleeves have an increased thickness for connecting to the tubular metal part.

17. The annular barrier according to claim 1, wherein the second thickness is at least 5% thicker than the first thickness.

18. The annular barrier according to claim 1, wherein the first expandable metal sleeve and the second expandable metal sleeve have a length along the axial extension being at least 50% longer than a length of the connecting sleeve.

19. The annular barrier according to claim 1, further comprising at least one annular sealing element arranged on an outer face of the expandable metal sleeves.

20. Downhole system comprising a plurality of the annular barriers according to claim 1 and the well tubular metal structure.

* * * * *